United States Patent [19]

Fabi et al.

[11] Patent Number: 4,955,330

[45] Date of Patent: Sep. 11, 1990

[54] CAM DRIVE MECHANISM FOR INTERNAL COMBUSTION ENGINE

[76] Inventors: Christian Fabi; Antoine Fabi, both of 209 Belvedere Nord, Sherbrooke, Quebec, Canada, J1H 4A7

[21] Appl. No.: 454,725

[22] Filed: Dec. 20, 1989

[30] Foreign Application Priority Data

Dec. 28, 1988 [CA] Canada ..... 587071

[51] Int. Cl.[5] ..... F01L 1/34; F02P 5/00

[52] U.S. Cl. ..... 123/90.17; 123/420; 123/501; 123/90.31; 464/3

[58] Field of Search ..... 123/90.15, 90.17, 90.31, 123/420, 500, 501; 464/1, 3, 5

[56] References Cited

U.S. PATENT DOCUMENTS

| | | | |
|---|---|---|---|
| 1,029,026 | 6/1912 | Newman | 464/1 |
| 2,260,983 | 10/1941 | Walker | 123/90.16 |
| 2,279,413 | 4/1942 | Read | 123/347 |
| 2,281,883 | 5/1942 | Kosian | 123/90.17 |
| 3,145,324 | 8/1964 | Race | 123/420 |
| 3,482,559 | 12/1969 | Salomon | 123/420 |
| 3,516,394 | 6/1970 | Nichols | 123/90.17 |
| 3,942,492 | 3/1976 | Iguchi | 123/420 |
| 4,502,425 | 3/1985 | Wride | 123/90.16 |
| 4,535,737 | 8/1985 | Takami | 123/420 |
| 4,744,339 | 5/1988 | Nagai et al. | 123/420 |

FOREIGN PATENT DOCUMENTS

| | | | |
|---|---|---|---|
| 1202850 | 4/1986 | Canada . | |
| 1935729 | 2/1970 | Fed. Rep. of Germany | 123/420 |
| 2248725 | 5/1975 | France | 123/90.15 |
| 0025937 | 2/1977 | Japan | 123/420 |
| 0050736 | 4/1979 | Japan | 123/90.15 |
| 0032625 | 2/1984 | Japan | 123/501 |

*Primary Examiner*—David A. Okonsky
*Assistant Examiner*—Weilun Lo
*Attorney, Agent, or Firm*—Darby & Darby

[57] ABSTRACT

Disclosed is a mechanism for use to progressively vary the angular relationship of the cam shaft of an internal combustion engine relative to the crank shaft of this engine. The mechanism comprises a first disk provided with two radially extending cavities aligned with respect to each other, each of the cavities containing a spring-biased, small weight slidably mounted therein with the spring uring said small weight toward the center of the first disk. The first disk is connected to the crank shaft in such as a manner as to be driven by, and rotated at the same speed as this crank shaft. The mechanism also comprises a second disk coaxially mounted with respect to the first disk. The second disk is provided with two arcuated slots of indential curvatures that are symetrical with respect to the center of the second disk and extends from a short distance away from the center of this second disk towards its periphery in opposite directions. This second disk is connected to the cam shaft in such a manner as to cause this cam shaft to be driven by and rotate at the same speed as the second disk when the same is driven into rotation by the first disk, both disks being interconnected by a pair of connecting pins that are solid with the small weights and extend into the arcuated slots along which they may move freely.

9 Claims, 3 Drawing Sheets

CAM DRIVE MECHANISM FOR INTERNAL COMBUSTION ENGINE

BACKGROUND OF THE INVENTION (a) Field of the Invention

The present invention relates to a mechanism for use in an internal combustion engine comprising a crank shaft and at least one cam shaft, in order to progressively vary the angular relationship of each cam shaft relative to the crank shaft when the rotational speed of this crank shaft increases or decreases.

(b) Brief Description of the Prior Art

It is known that the pistons moving up and down inside the cylinders of an internal combustion engine are connected to a crank shaft and work in time or at given internal with respect to each other according to a predetermined angle or a multiple of this angle.

It is also known that the inlet and exhaust valves of an internal combustion engine are operated by a set of rotating cams mounted onto a cam shaft which is connected to, and driven into rotation by the crank shaft. These cams are positioned all around the cam shaft at different angles that are determined by the relative position of the corresponding pistons inside the cylinders. As a result, a given valve is set to open during each cycle of the motor, at a predetermined time which is set once for all in the cycle.

It is further known that to advance or to delay the openings of the inlet and exhaust valve with respect to the relative position of the pistons inside the cylinders may improve the power torque produced by the engine at different speeds and, therefore, the efficiency of this engine. Such a variation in the "timing" of the inlet and exhaust valves opening and closing, however, is not very easy to achieve.

Up to now, the car manufacturers have come up with two different solutions to the above mentioned problem, which are either to adjust the timing to achieve maximum power torque at low speed, or to adjust this timing to achieve maximum power torque at high speed. Other solutions have also been proposed to devise an internal combustion engine that would give a maximum power torque at any speed (see Canadian patent No. 1,202,850 and U.S. Pat. Nos. 2,260,983; 2,279,413; 2,281,883 and 4,502,425). However, all the mechanisms that were proposed so far for this purpose, are not satisfactory because of their structural complexity and/or their substantial cost.

OBJECT OF THE INVENTION

The object of the present invention is to provide a mechanism for use in an internal combustion engine, which allows the engine to provide maximum power torque at any speed and which is very simple in structure and of low cost of manufacture and installation.

SUMMARY OF THE INVENTION

According to the invention, the above mentioned object is achieved with a mechanism making use of two rotating disks which are respectively mounted onto the cam shaft or onto an extension of the crank shaft and whose angular relationship with respect to each other may vary. The cam shaft can be one operating the inlet valves, one operating the exhaust valves or one operating both of them.

More particularly, the invention provides a mechanism for use in an internal combustion engine comprising a crank shaft and at least one cam shaft, which mechanism comprises a first disk provided with two radially extending cavities aligned with respect to each other, each of said cavities containing a spring-biased small weight slidably mounted therein with the spring urging the small weight toward the enter of the disk.

Means are used for connecting the first disk to the crank shaft to cause this first disk to be driven by, and rotated at the same speed as the crank shaft.

The mechanism according to the invention also comprises a second disk coaxially mounted with respect to the first disk. This second disk is provided with two arcuated slots of identical curvature which are symmetrical with respect to the center of the second disk and extend from a short distance away from this center toward the periphery of the second disk, in opposite directions.

Means are used for connecting the second disk to each cam shaft to cause this cam shaft to be driven by and rotate at the same speed as the second disk.

The mechanism according to the invention further comprises connecting pins solid with the small weights, which are engaged into the articulated slots and are free to move therein so as to drive into rotation the second disk when the first disk rotates.

In use, when the rotational speed of the crank shaft varies, the small weights mounted in the cavities of the first disk radially slide along these cavities under the action of the centrifugal force and the pins connected thereto move along the arcuated slots of the second disk and thus progressively vary the angular relationship of the second disk with respect to the first one.

With such a mechanism, the higher is the speed of the engine, the earlier will open the inlet valves before the pistons reach their dead points, i.e. the points at the end of their stroke, which is the closest to the sparking plug. Inversely, if the speed of the engine is low, the inlet valves will open substantially when the piston reach this dead point.

According to a preferred embodiment of the invention, the first disk is freely mounted onto the cam shaft and is connected to the crank shaft by a set of cogged wheels connected by an endless chain. In this particular embodiment, the second disk is rigidly mounted onto the cam shaft, adjacent the first disk.

The power output of the engine can be optimized by suitably selecting the curvature of the arcuated slots to cause variation of the angular relationship of the disks with respect to each other as a function of the "normal" operation of the engine.

Other features and advantages of the mechanism according to the invention will become more apparent on reading the following, non restrictive description of a preferred embodiment thereof, made with reference to the accompanying drawings.

DESCRIPTION OF A PREFERRED EMBODIMENT

Figure 1:
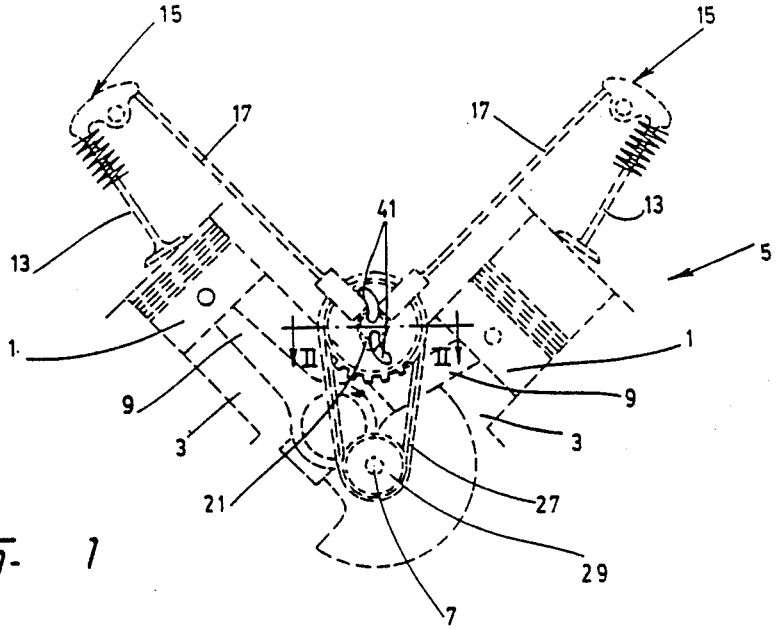
FIG. 1 is a diagrammatic elevational view of the front end of an internal combustion engine provided with a mechanism according to the invention.

FIG. 1 of the drawings shows two pistons 1 mounted in two corresponding cylinders 3 of an internal combustion engine 5. As it is well known in the art, the pistons 1 are connected to a crankshaft 7 by crank heads. FIG. 1 also shows two inlet and/or outlet valves 13 that are each operated through a rocker arm 15 by a push rod 17 which abuts and follows one of the cams 21 of a camshaft 19. The pistons 1 that are shown in FIG. 1 move in phase whereas the other pistons that are not shown, are shifted out of phase with respect to the pistons 1.

Figure 2:
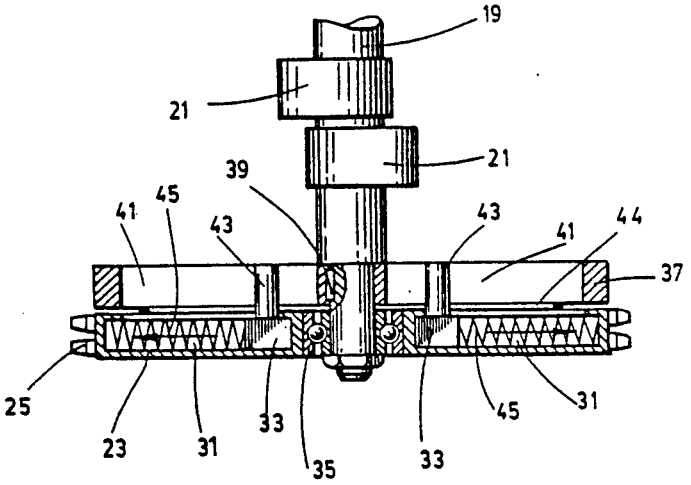
FIG. 2 is a cross-sectional view taken along line II—II of FIG. 1.

The mechanism for use to progressively vary the angular relationship of the camshaft relative to the crank shaft of the engine 5 is better shown in FIG. 2. It comprises a first rotating disk 23 provided with a cogged peripheral rim 25 which is connected by an endless chain 27 to a pinion 29 keyed onto the crank shaft 7. As a result, the first disk 23 is driven by the crank shaft 7. The first disk 23 is also provided with radially extending cavities 31 that are aligned with respect to each other. Each of the cavities 31 contains a small weight 23 that is slidably mounted therein. The first disk 23 is freely mounted onto an axial extension of the camshaft 19 by means of a roller bearing 35.

The mechanism according to the invention also comprises a second rotating disk 37 which is coaxially mounted with respect to the first disk onto the camshaft 19 and is keyed onto this camshaft by means of a small key 39 so as to drive and rotate at the same speed as the camshaft 19. The second disk 37 is provided with two arcuated slots 41 of identical curvatures, which are symmetrical with respect to the center of the second disk as is clearly shown in the FIGS. 3 and 4 and which extend from a short distance away from this center towards the periphery of the second disk, in opposite directions. These arcuated slots 41 may be oriented in the same direction as a rotational direction of the disks or in the opposite direction, depending on whether opening of the valves 13 is to be advanced or delayed.

The mechanism according to the invention further comprises connecting pins 43 that are solid with the small weights 33 and engage the arcuated slots 41 in which they are free to move, so as to drive into rotation the second disk when the first disk rotates. As it is clearly shown in FIG. 2, the connecting pins 43 extend parallel to the common axis of the disks 23 and 37 and pass through linear slots provided for this purpose in the wall of the cavities 31 facing the second disk 37.

Figure 3:
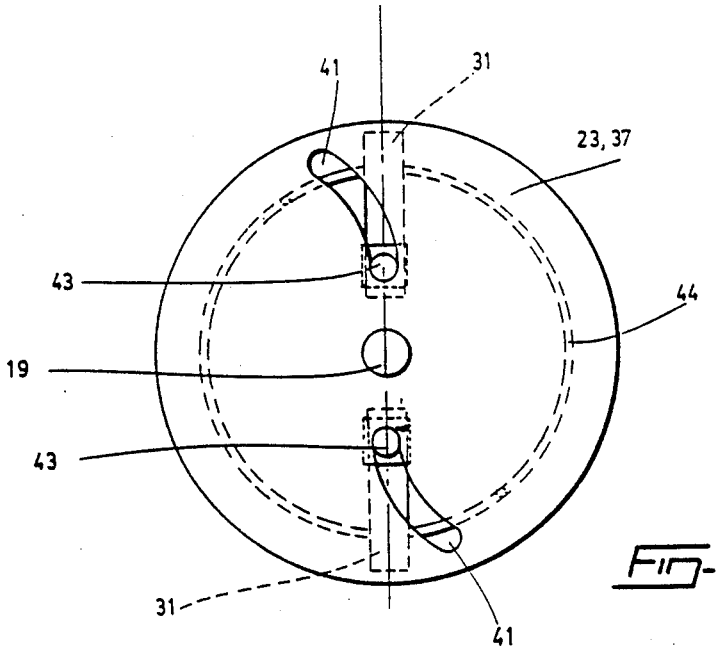
FIGS. 3 and 4 are diagrammatic views of the set of disks of the mechanism according to the invention, shown with the small weights in two different positions.
Figure 4:
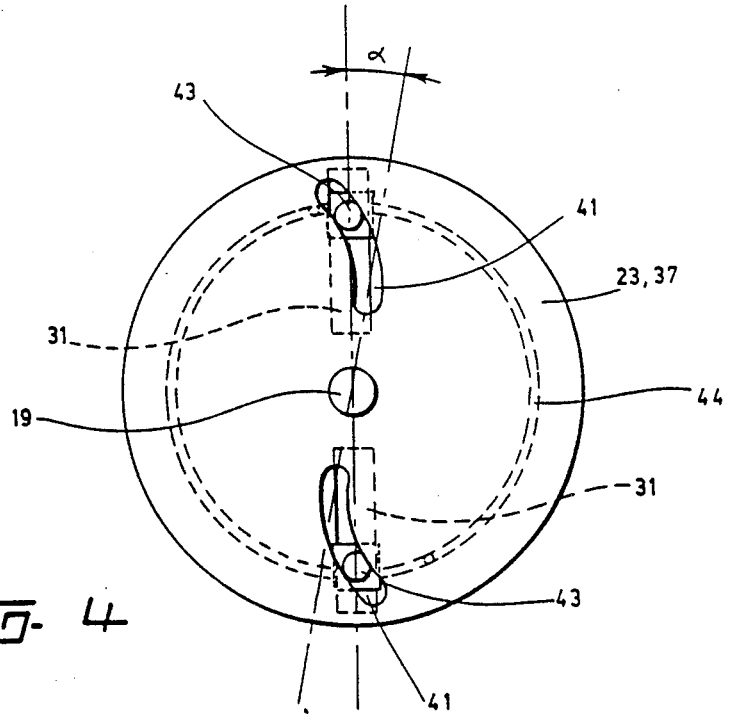

As can now be easily understood, when the rotational speed of the crank shaft 7 increases, the small weights 33 moves radially outwardly in the cavities 31 (see the arrows in FIG. 2) under the action of the centrifugal force. The pins 43 connected to the small weights simultaneously move along the arcuated slots 41 of the second disk 37 and thus cause a progressive variation in the angular relationship of this second disk 37 with respect to the first one. FIGS. 3 and 4 clearly show this motion which causes a variation in the value of the angle $\alpha$ and thus allows opening of the valves 13 to be delayed or advanced as was explained hereinabove.

A spring 45 is advantageously provided into each cavity 31 to urge the small weight 33 back toward the center of the first disk as soon as the engine slows down.

The curvature of the arcuated slots 41 is advantageously selected to cause variation of the angular relationship of the disks 27 and 37 with respect to each other as a function of the normal operation of the engine. However, such a curvature may be otherwise selected.

Resilient connection means may be intercalated between the disks 23 and 37 to compensate lateral torque generated between these disks. Such means may consist of an arc-shaped return spring 44 as is shown in the drawings, having one end fixed to the first disk and the other end fixed to the second disk.

Figure 5:
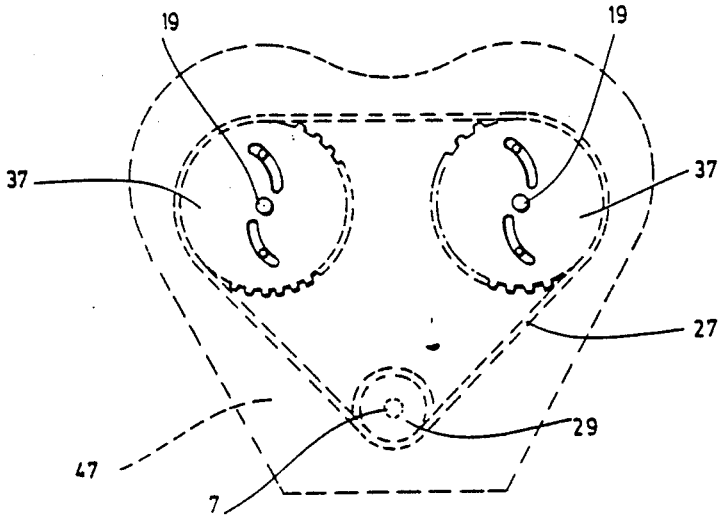
FIG. 5 is a diagrammatic view of a V-type engine provided with two synchronized cam shafts.

FIG. 5 shows that two mechanisms according to the invention can be respectively mounted onto the camshafts 19 of a V-type engine 47, such a manner that they are both driven by the same crank shaft 7. This mechanism can also associated in pair and be mounted onto an overhead, double camshaft. In such a case, the slots 41 of one of the disks 37 shall be oriented in a direction opposite to the slots 41 of the other second disk 37.

As mentioned hereinabove, the mechanism according to the invention can be mounted on either the inlet valves operating camshaft, the outlet valves operating camshaft or the inlet and outlet valves operating camshaft. Both disks may also be mounted onto an extension of the crank shaft rather than the camshaft as was disclosed hereinabove.

We claim:

1. A mechanism for use in an internal combustion engine comprising a crank shaft and at least one cam shaft, said mechanism being designed to progressively vary the angular relationship of said at least one cam shaft relative to said crank shaft, and comprising a first disk provided with two radially extending cavities aligned with respect to each other, each of said cavities containing a spring-biased small weight slidably mounted therein, said spring urging said small weight towards the center of said first disk;

means for connecting said first disk to said crank shaft to cause said first disk to be driven by said crank shaft;

a second disk coaxially mounted with respect to said first disk, said second disk being provided with two arcuated slots of identical curvatures, said slots being symmetrical with respect to the center of said second disk and extending from a short distance away from said center towards the periphery of said second disk in opposite directions;

means for connecting said second disk to said at least one cam shaft to cause said cam shaft to rotate at the same speed as said second disk; and connecting pins integral with said small weights, said pins being engaged into the arcuated slots and free to move therein so as to drive into rotation said second disk when the first disk rotates;

wherein, when the rotation speed of the crank shaft varies, the small weights radially sliding in the cavities of the first disk under the action of the centrifugal force, and cause the pins connected thereto to move along the arcuated slots of the second disk and thus to progressively vary the angular relationship of the second disk with respect to the first disk.

2. A mechanism as claimed in claim 1, wherein said second disk is rigidly mounted onto said at least one cam shaft and wherein said first disk is freely mounted onto said at least one cam shaft and wherein said means for connecting said first disk to said crank shaft comprises a set of cogged wheels connected by an endless chain.

3. A mechanism as claimed in claim 2, wherein the curvature of said arcuated slots are oriented in the same direction as the rotational direction of said disks.

4. A mechanism according to claim 2, wherein one of said cogged wheels is formed by said first disk and the other said cogged wheel is a pinion fixed to the crank shaft.

5. A mechanism according to claim 1, wherein the curvature of the arcuated slots is selected as a function of the required amount of variation of the angular relationship of one of said disks with respect to the other.

6. A mechanism according to claim 1, wherein the curvature of the arcuated slots is selected to cause variation of the angular relationship of one of said disks with respect to the other as a function of the normal operation of the engine.

7. A mechanism according to claim 1, further comprising resilient means mounted between the first and second disks for compensating lateral torque that may be generated in between.

8. A mechanism according to claim 1, wherein the first disk has a flat surface adjacent said second disk and wherein said flat surface is provided with two linear slots, each of said linear slots extending along and opening into one of said cavities to let pass the connecting pin integral with the small weight located inside each of said cavities, out of said flat surface toward said second disk.

9. A mechanism according to claim 1, further comprising at least one return spring mounted between the first and second disks, said spring having ends respectively fixed to the first and second disks to compensate lateral torque that may be generated between said disks.

* * * * *